US006434893B1

(12) United States Patent
Quenzi

(10) Patent No.: US 6,434,893 B1
(45) Date of Patent: Aug. 20, 2002

(54) APPARATUS AND METHOD FOR PLACING ELEVATED CONCRETE SLABS

(75) Inventor: Philip J. Quenzi, Atlantic Mine, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/517,843

(22) Filed: Mar. 2, 2000

(51) Int. Cl.[7] ..... E04B 1/16

(52) U.S. Cl. ..... 52/126.1; 52/126.5; 52/127.2; 52/742.14; 52/741.1; 52/414; 52/1

(58) Field of Search ..... 52/1, 126.1, 126.5, 52/127.2, 742.14, 741.1, 749.1, 414, 223.6, 223.14, 291; 248/351, 354; 249/78

(56) References Cited

U.S. PATENT DOCUMENTS

| | | | | |
|---|---|---|---|---|
| 1,541,290 A | * | 6/1925 | Streit | 248/351 |
| 2,427,021 A | | 9/1947 | Rapp | |
| 2,479,477 A | * | 8/1949 | Cusano | 52/640 |
| 2,493,620 A | * | 1/1950 | Cusano | 254/98 X |
| 3,066,448 A | * | 12/1962 | Pinter | 52/126.5 |
| 4,008,123 A | * | 2/1977 | Kirjavainen | 52/1 X |
| 4,191,496 A | * | 3/1980 | Becker | 248/550 X |
| 4,718,628 A | * | 1/1988 | Vitta | 52/126.1 X |
| 4,995,204 A | * | 2/1991 | Kelso | 52/126.1 |
| 5,313,749 A | * | 5/1994 | Conner | 52/223.12 |
| 5,398,462 A | * | 3/1995 | Berlin et al. | 52/1 |
| 5,671,572 A | | 9/1997 | Siller-Franco | |
| 5,970,665 A | * | 10/1999 | Oudman | 52/126.6 |
| 6,065,257 A | * | 5/2000 | Nacey et al. | 52/223.8 |

OTHER PUBLICATIONS

Copy of the International Search Report for the counterpart international application.

* cited by examiner

*Primary Examiner*—Beth A. Stephan
*Assistant Examiner*—Brian E. Glessner
(74) *Attorney, Agent, or Firm*—Van Dyke, Gardner, Linn & Burkhart, LLP

(57) ABSTRACT

An automatic or active shoring apparatus and process for controlling the deflection of the beams and girders typically in an elevated structure prior to and while concrete is placed and screeded on the beams and girders comprises a beam adjusting device and a beam monitor. The beam adjusting device is operable to adjust a curvature of the beam in response to the beam monitoring device, which measures and monitors the curvature of the beam throughout the placing and screeding processes. The beam adjusting device may comprise a heating device with or without a cooling device such as a fan, a cooling device, an adjustably weighted container, or a horizontally mounted fluid cylinder or jack. The curvature of each beam is automatically adjusted and maintained at a substantially level orientation prior to and while concrete is placed, screeded and cured at each beam. The present invention thus avoids the necessity of pre-placing concrete at the beams and further results in a slab where the concrete may be placed more efficiently and more accurately over conventional processes. Aspects of the present invention may be equally applicable on precambered beams as well as on straight or level beams.

54 Claims, 7 Drawing Sheets

APPARATUS AND METHOD FOR PLACING ELEVATED CONCRETE SLABS

BACKGROUND OF THE INVENTION

The present invention relates generally to a method for placing concrete on elevated slabs and, more particularly, to a method for placing and screeding concrete on the elevated slabs which results in a substantially flat and level floor of substantially uniform thickness.

Beams and girders for supporting elevated slabs, such as floors of buildings and the like, are typically I-beams which are often pre-cambered with an upwardly curved initial form to counteract the loads that they will have to support. Corrugated sheet metal decks are then placed on the beams and girders and concrete is placed and screeded over the sheet metal to form the slab. Typically, the specified camber of the beams and girders is 80% of the deadload deflection and, for beams having a length of about thirty feet, is often in a range of approximately one inch to one and one half inches at the center of the beam, with a tolerance in a range of plus or minus approximately one-half inch. As the concrete is placed over the beams and girders, the beams and girders deflect downward under the load of the concrete. Because of the camber in the beams and the variable deflection of the beams under load, a use of known screeding systems, which are used to strike off, level and smooth the concrete, often results in a floor that is not flat, not level, and not of uniform thickness.

In order to counter the camber in the beams, concrete is often pre-placed within each bay (the area enclosed by four adjacent columns) to cause an initial downward deflection of the beams and girders. It is then possible to strike off the concrete to a uniform thickness over the sheet metal decking. However, more concrete than is actually necessary is placed at the beams to assure an adequate amount of material for strike off. The excess material may cause over-deflection in some areas, which results in low areas. As more concrete is added to fill in these low areas, further deflection may occur, which results in a slab or floor which is not flat or level.

One proposed method to obtain uniform thickness in the concrete slab is to place stands, which are fabricated metal structures that have support legs which rest on the deck and a top surface that is at the desired concrete thickness, on the metal deck. The screed then rides along the top surface of the stands, similar to a method used on slabs on grade, prior to implementation of laser screeding. The stands may later be removed before the concrete cures. Another method of obtaining a uniform thickness slab is to provide "wet screed" pads at a desired height above the deck followed by hand-screeding the bay or bays using the wet screed areas as a guide. The wet screed pads are made by using a handheld laser and hand trowel to strike off a roughly twelve inch diameter area of the pre-placed concrete. Two of these pads are made about ten feet apart and then a 2×4 or other straight edge is used to strike off a 12"×10' surface between the two twelve inch diameter pads. Two of these 12"×10' struck off pads are made parallel to each other at the width of the handheld screed being used. The concrete is then struck off between these two parallel surfaces using the surface as guides for the hand held screed. While either of these methods may provide a floor or slab of generally uniform thickness, they often result in over-deflection of the beams due to excess concrete being placed in the bays prior to screeding, since the concrete must be placed high enough to assure that there is enough material before screeding.

Over-deflection of the beams results in a slab which has a lower center, such that additional concrete has to be placed in the center region to bring the slab back up to grade. This additional concrete further results in additional deflection. This is referred to as "ponding" in the industry and causes substantially more concrete usage and a slab that is not of uniform thickness. In many cases, ponding may result in up to 30% more concrete usage, which adds significantly to the cost of a project.

In order to counteract the ponding of the slab, 4"×4" wood shores may be placed between the beams and girders and the slab below to support the beams and girders as they are loaded. The shores have a length which provides a gap between the shores and the beams approximately equal to the initial beam camber. The shores thus limit over-deflection of the beams and girders. However, the shores interfere with the slab or area below and do not necessarily result in a floor that is flat and level. If the beams are over cambered, and the concrete weight is not sufficient to deflect the beam to a level orientation, the beams (if the bay is not pre-filled) will be continuously deflecting as the concrete is being placed, thereby resulting in non-level floors. Because the cost of correcting problems with uneven elevated slab floors after the concrete has set is high, it is highly desirable to achieve an even floor during the first placing and screeding process.

Accordingly, there is a need in the art for an improved method for placing and screeding concrete on elevated slabs, such as those supported on beams or girders. The method should account for the camber in the beams and provide a flat and level concrete floor of uniform thickness.

SUMMARY OF THE INVENTION

The present invention is intended to provide a system to compensate for beam deflection in elevated steel beams and girders while concrete is placed and screeded on slabs supported by the beams and girders. The system automatically reacts to varying loads on the beams to maintain the beams in a substantially flat and level orientation during the placing and screeding processes. This eliminates the need to pre-fill the bays and provides for the use of laser type screeding of the placed concrete, which has been proven in slab-on-grade screeding, i.e., concrete poured, smoothed and leveled on the earth or ground. Accordingly, the present invention allows for more efficient and accurate placing and screeding processes in elevated slab situations over conventional methods. Aspects of the present invention may be equally applicable on pre-cambered beams as well as on straight or level beams.

According to a first aspect of the present invention, an active shoring system for adjusting the curvature of at least one beam for supporting concrete comprises a beam monitor and a beam adjusting device. The beam monitor is operable to monitor the curvature of the beam. The beam adjusting device is operable to selectively adjust the curvature of the beam in response to the beam monitor, thereby maintaining a substantially level beam while the concrete is placed at the beam. The beam may be cambered to have an upwardly curved initial form. Preferably, the beam adjusting device initially adjusts the curvature by removing the camber in the beam prior to placing of the concrete at the beam to eliminate the need for prefilling of the area or bay associated with the beams.

In one form, the beam adjusting device is a heating device, preferably positioned along a lower flange of the beam, which at least initially heats the beam to reduce the curvature of the beam. In like manner, the upper flange of the beam could be cooled to obtain the same effect. A cooling fan may be provided which is operable to cool the beam in response to the beam monitor detecting a generally level orientation of the beam. In another form, the beam adjusting device comprises an adjustably weighted container, the weight of which may be increased or decreased to adjust the curvature of the beam in response to the beam monitor. In yet another form, the beam adjusting device may comprise a generally horizontally mounted hydraulic cylinder or jack secured to opposite ends of each beam, such that extension and retraction of the hydraulic cylinder causes a decrease or increase in the curvature of the beam.

According to another aspect of the present invention, a method for actively adjusting a curvature of at least one beam comprises the step of providing at least one beam and placing concrete for support by the beam. The curvature of the beam is then monitored with a measuring device. The curvature is then automatically adjusted in response to the measuring device, in order to maintain a generally level orientation of the beam while the concrete is placed at the beam. In one form, the beam is provided with a camber, such that the beam has an initial upward curvature therealong. Preferably, the curvature of the beam is initially reduced such that the beam is at a generally level orientation prior to the step of placing concrete at the beam.

Therefore, the present invention provides an active shoring system which maintains a substantially level orientation of the beams and girders of a bay area of a structure or building while concrete is being placed, screeded and/or cured at the bay region. This is accomplished without requiring pre-filling of concrete at the bay, since the beams and girders may be straightened or leveled prior to placing concrete at the area above them. This results in floors which are substantially flat, level, and of uniform thickness throughout. The present invention thus substantially reduces the likelihood of ponding and of waste and/or repair of the concrete slabs. Therefore, the present invention provides a system and method for allowing the placing and screeding of concrete at elevated slabs which is more efficient and produces a flatter, higher quality floor over conventional processes.

These and other objects, advantages, purposes and features of this invention will become apparent upon review of the following specification in conjunction with the drawings.

DESCRIPTION OF THE PREFERRED EMBODIMENTS

Figure 1:
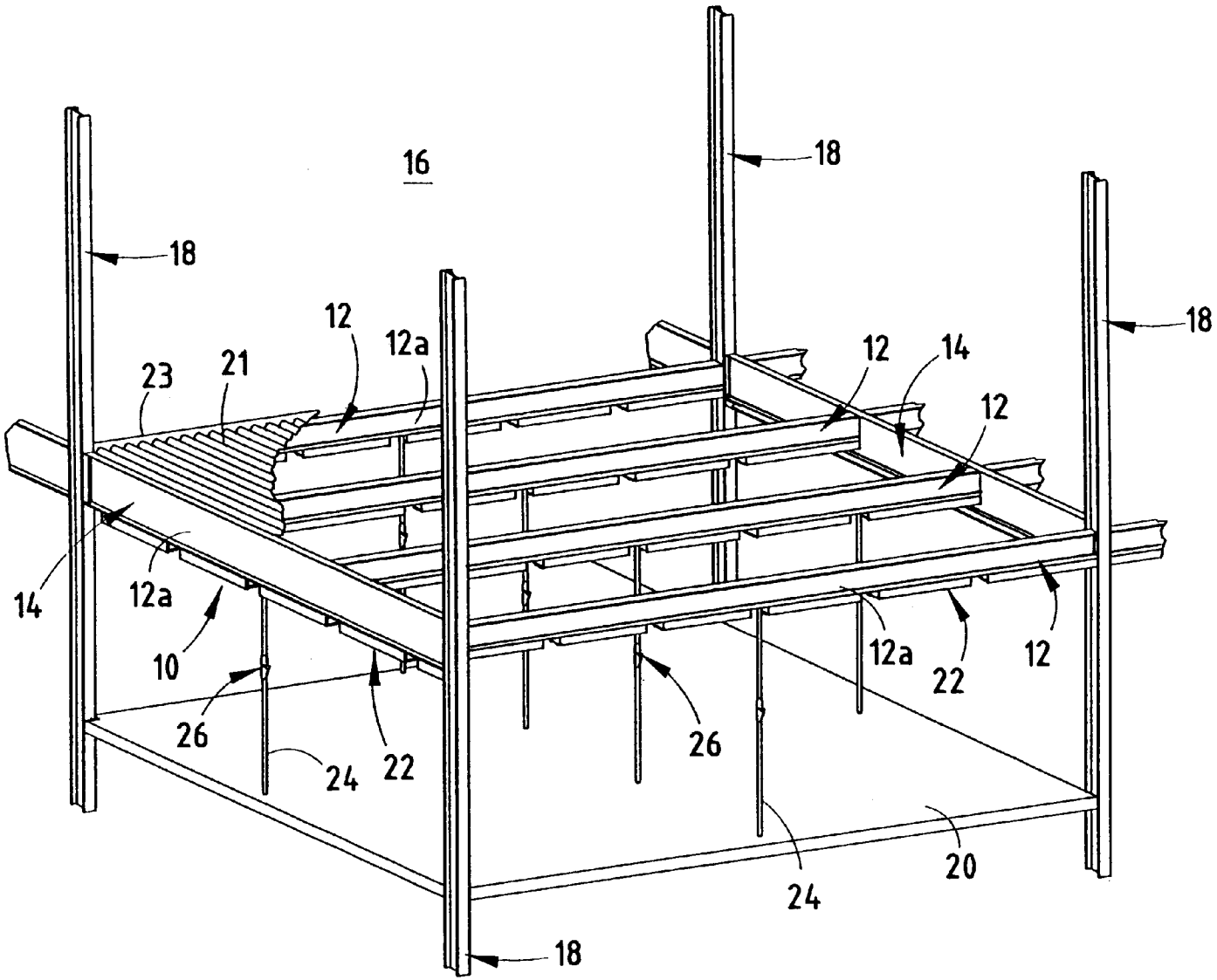
FIG. 1 is a perspective view of the present invention implemented on a plurality of beams and girders of a single elevated bay.

Referring now to the drawings and the illustrative embodiments depicted therein, an active shoring system 10 is positioned at each beam 12 and girder 14 of an elevated flooring bay 16 in a newly constructed high-rise or other building (FIG. 1). One or more bays define the building or structure. Each bay 16 is defined by a plurality of vertical I-beams or columns 18 which support the ends of the beams 12 and girders 14 about the perimeter of the bay. The structure may be a building which comprises multiple levels, such that the vertical columns 18 support a level of beams 12 and girders 14 above one or more lower levels or a floor or slab 20. A corrugated metal deck 21 is placed over the beams and girders of each bay prior to placing concrete at or in the bay. An angle iron 23 or the like is provided around the perimeter of the targeted area to contain the concrete at the edges of the slab. The present invention is applicable to conventional beams 12 and girders 14, which are typically I-beams. Such I-beams are often initially cambered such that they have an initially upwardly curved center region 12*a*, which allows the beams to flex or sag downwardly in their length portions between their fixed ends as the concrete is placed on the respective bays. Although the present invention is applicable to both beams and girders of the bays of a building, for the sake of brevity and clarity the following discussion refers only to the present invention being implemented at one or more beams. This is intended to refer to both the beams and girders of each bay of the building or structure, since the present invention is equally applicable to both the beams and girders of the structure.

Active shoring system 10 comprises a beam leveling or adjusting device 22 at each beam 12, which adjusts the curvature of the beams and girders as the concrete is placed, screeded and/or cured at each bay. Active shoring system 10 further comprises a beam monitoring device 26, which is operable to monitor the deflection of each beam and girder, such that the beam adjusting device 22 may be activated and deactivated at an appropriate time, such as at one or more threshold levels of curvature or deflection, in order to maintain a substantially level beam while the concrete is placed, screeded and/or cured on the deck above the beams. For example, adjusting device 22 may be operable to reduce the upward curvature of the beam toward a level orientation in response to a first threshold curvature being detected by beam monitoring device 26, while adjusting device 22 is further operable to resist over deflection or allow the beam to curve toward its initial cambered state in response to a second threshold level of curvature. Preferably, a vertical support or column 24 is positioned beneath a center region 12*a* of each beam 12 to prevent over-deflection of the beams as concrete is placed thereon. Beam adjusting device 22 may be operable to initially reduce an initial curvature or camber of the beam prior to placing or screeding the concrete. Accordingly, in the present invention, in contrast to certain prior known methods of placing and screeding concrete in elevated bays of buildings, no pre-loading of the bay 16 with concrete is required to initially level out the cambered beams.

As shown in FIGS. 1–4, beam adjusting device 22 preferably comprises one or more heating devices, which are removably and adjustably positioned at spaced positions along at least a portion of each beam 12. The heaters 22 are operable to heat the beams, which allows the center regions of each beam to straighten or level out prior to placing the concrete. Preferably, the heating devices are positioned along a lower surface 12*b* of a lower flange 12*c* of each beam 12. The adjusting device 22 may comprise a plurality of elongated heating devices spaced along each beam, and removably mounted to the lower flange 12*c*. Preferably, each of the heating devices 22 comprises one or more hooks 23 or pairs of hooks, such that heating devices 22 are hooked or otherwise removably mounted to the lower flange 12*c*. The heating devices thus may be easily attached to each beam prior to placing the concrete and removed from each beam after the concrete has cured. The heating devices may then be moved to the beams and girders of the next bay for repeated use. One or more elongated insulation members 28 may be positioned along an upper surface 12*d* of lower flange 12*c* to retain the heat at flange 12*c* and to minimize heat dissipation to the remaining portions of beam 12 when heaters 22 are activated. The insulation members 28 may be any known insulating means, such as ceramic fiber insulation, fiberglass insulation or the like. The ceramic fiber insulation provides a dense yet fairly flexible insulating blanket along the lower flange 12*c* of the beam 12. Alternately, since the objective is to obtain a temperature differential between the upper and lower flanges of the beam, the upper flange 12*e* could also be cooled, with or without heating of the lower flange 12*c*, to reduce the initial curvature or camber of the beam.

Figure 6:
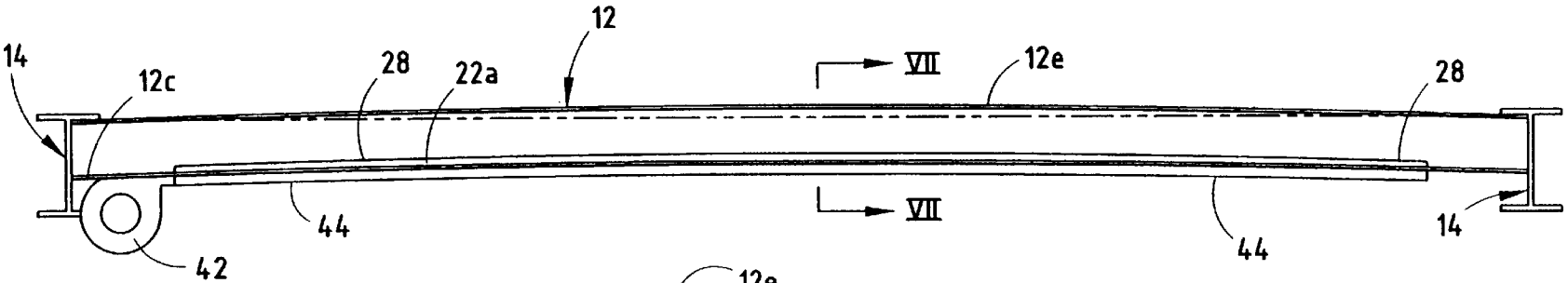
FIG. 6 is a side view of a beam in accordance with the present invention with a blower and air duct mounted thereon.
Figure 7:
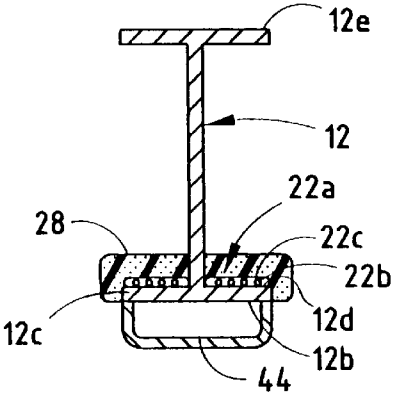
FIG. 7 is a sectional view taken along the line VII—VII in FIG. 6.

Preferably, the heating devices 22 are operable to sufficiently heat the lower flange 12*c* of the beam 12 to allow the beam to flex enough to substantially remove the camber in the beam within a sufficiently short period of time. Testing has shown that providing a 200–400 degree F. temperature at the lower flange 12*c* of the beam for an adequate time period will result in enough deflection to reduce or substantially remove the camber from the beam. In the illustrated embodiments, the heating devices 22 comprise electric powered ceramic infra-red heaters rated at 5,000 watts per heater and commercially available as part number 3110K48 from McMaster Carr of Elmhurst, Ill. However, any other known means for heating a portion of the beam may be implemented, such as electric resistance heaters, direct flame heaters, blanket heaters, or the like, without affecting the scope of the present invention. Although shown with the heaters positioned along the lower surface of the lower flange 12*c*, it is envisioned that the heaters may be placed on the upper surface 12*d* of lower flange 12*c*, with the insulation 28 being placed above and/or below the heaters, or placed elsewhere along beam 12, without affecting the scope of the present invention. For example, as shown in FIGS. 6 and 7, a blanket heater 22*a* may comprise a plurality of electrical heating elements 22*b*, which may be embedded in a flexible silicon rubber blanket 22*c*, and may be positioned under the insulation blanket or cover 28, with the heating elements contacting the upper surface 12*d* of lower flange 12*c* of each beam 12.

In like manner, any known methods could be used to cool the upper flange 12*e* to accomplish the same result of reducing initial camber. For example, a cooling fan or blower such as that shown at 42 (FIG. 6) could be positioned to direct refrigerated air along upper flange 12*e* of the beam. Optionally, other methods of cooling the upper flange 12*e* could be used to create a sufficient temperature differential between the upper and lower beam flanges 12*e*, 12*c*.

Figure 3:
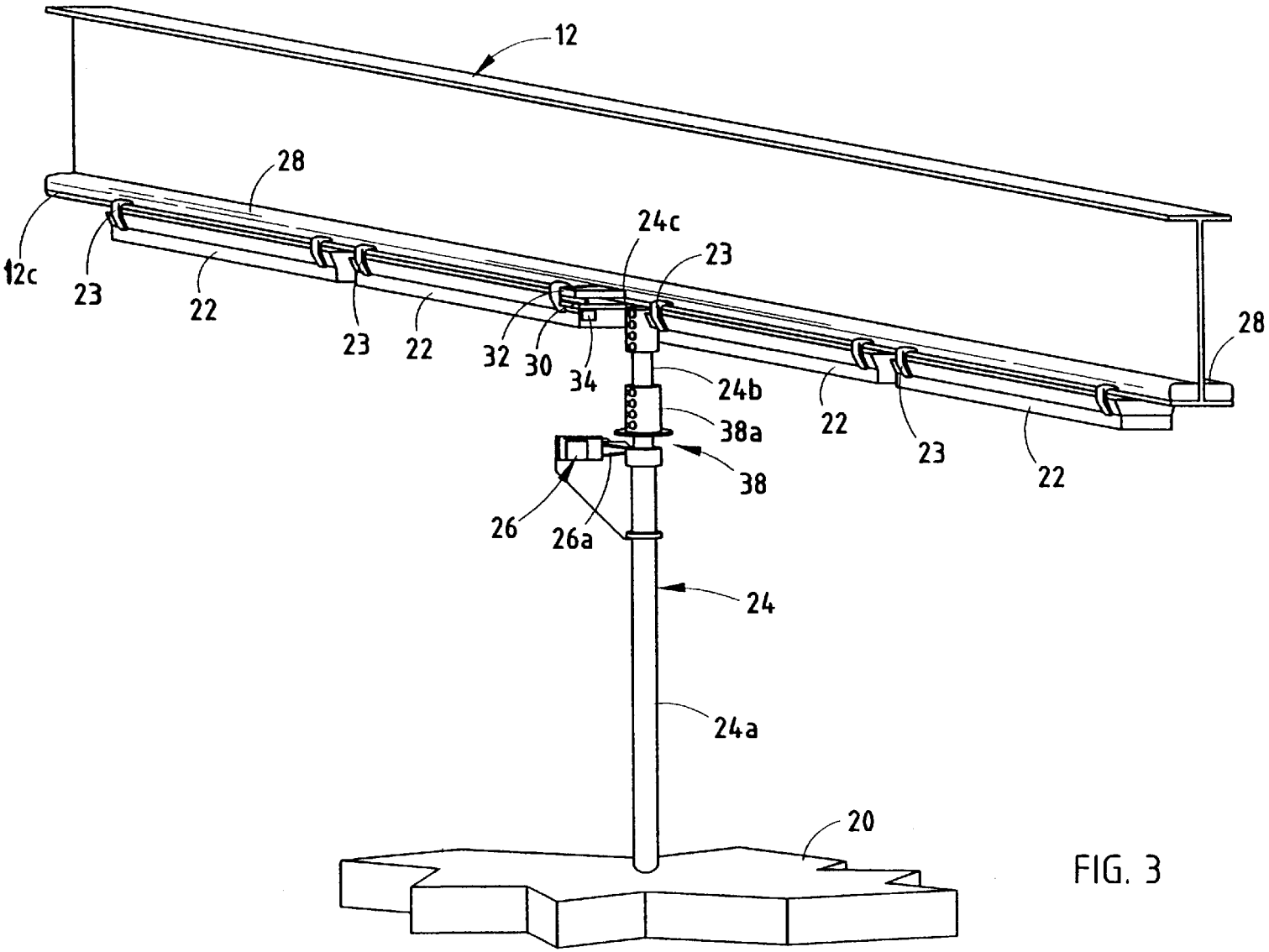
FIG. 3 is a perspective view of a center region of the beam of FIG. 2.
Figure 4:
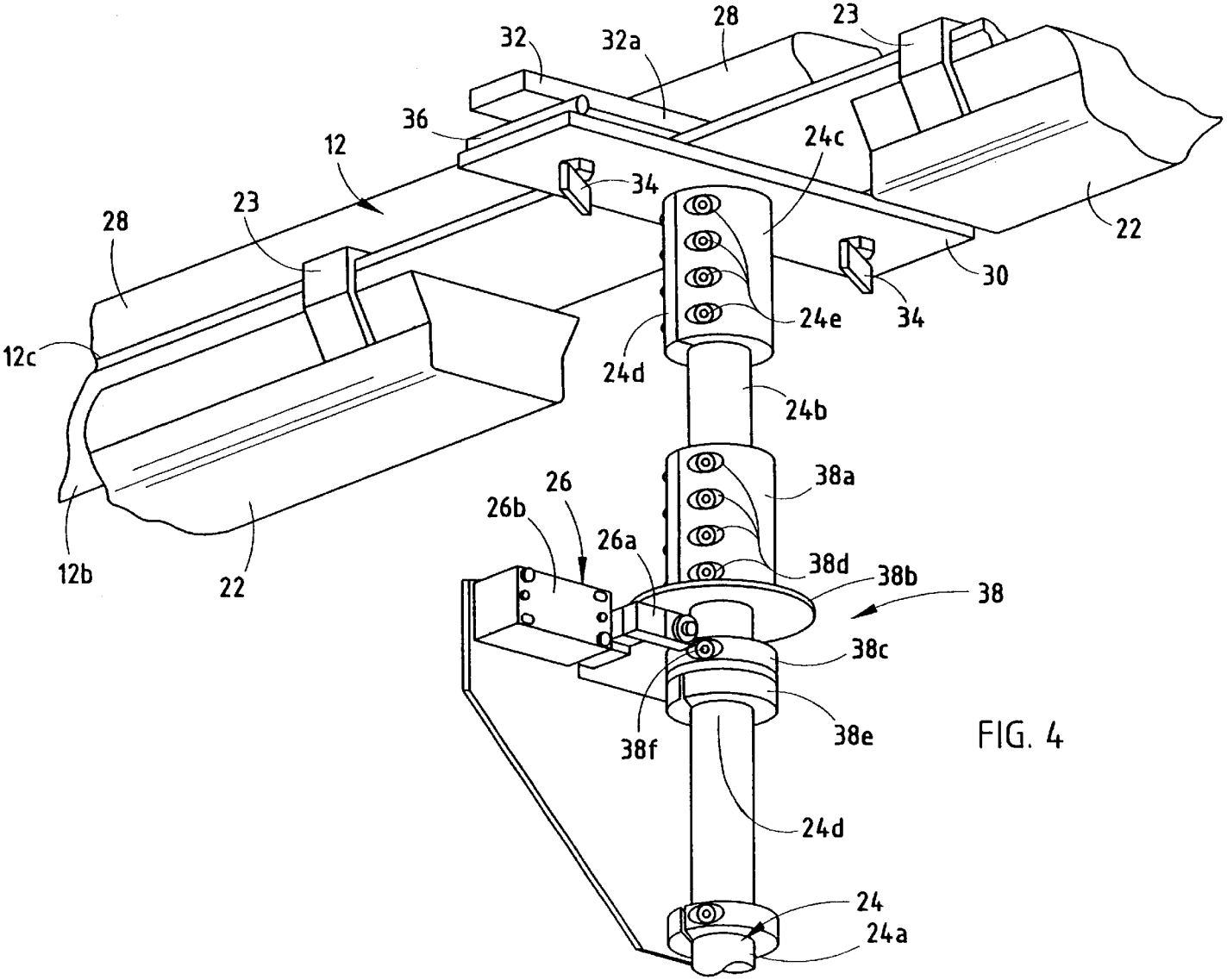
FIG. 4 is a close up perspective view of a limit switch and adjustable support column useful with the present invention.

Preferably, as is best seen in FIGS. 3 and 4, active shoring system 10 further comprises a vertical support 24, which is positioned between lower flange 12*c* of beam 12 and the slab or level 20 beneath beam 12, and is operable to prevent over-deflection of beam 12 as the camber is removed and as the concrete is placed above the beams. Preferably, support 24 comprises a vertical column, such as a telescoping tube assembly which comprises a lower outer tube 24*a* and an upper inner tube 24*b*, which is slidable within the lower, outer tube 24*a*. As best shown in FIG. 4, an upper end 24*c* of tube assembly 24 may be positioned at and mounted to lower flange 12*c* of beam 12 via a mounting plate 30 which preferably includes a split cylinder 24*d* secured to the outer diameter of the upper end of the tube 24*b* by a series of bolts/nuts 24*e* or the like. Plate 30, when secured to tube 24*b*, is clamped to lower flange 12*c* via a pair of upper clamping plates 32 on opposite sides of beam 14 and a corresponding pair of fasteners or set screws 34. A spacer 36 may be provided between the clamping members 32 and plate 30, with fasteners 34 spaced inwardly of spacer 36 toward flange 12*c*, such that as the fasteners 34 are tightened, an inner portion 32*a* of each clamping member 32 is pulled downward toward plate 30, thereby clamping and securing lower flange 12*c* between clamping members 32 and mounting plate 30.

Figure 5:
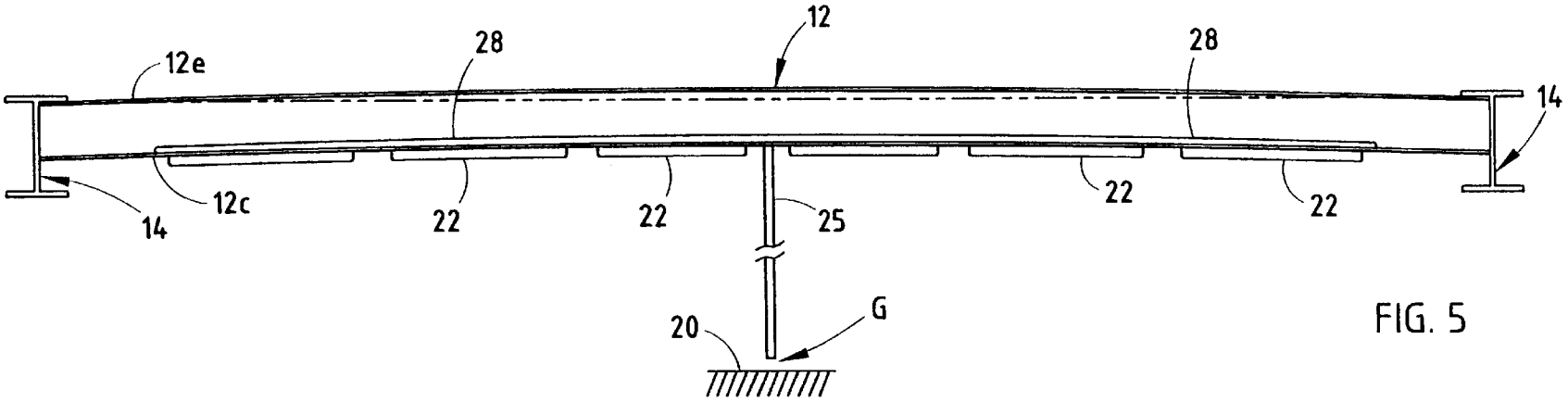
FIG. 5 is a side view of a beam with a non-adjustable support useful with the present invention.

Preferably, vertical support 24 further comprises a mechanical stop 38, which prevents the beam from overdeflecting as the concrete is placed thereon. As best shown in FIG. 4, the mechanical stop 38 may comprise a collar member 38*a* secured to inner tube 24*b* and a stop collar 38*c* on outer tube 24*a*. Collar member 38*a* is preferably a split cylinder fitted around the outside diameter of tube 24*b* and secured by a series of bolts/nuts 38*d* or the like, and may further comprise a radially outwardly extending flange 38*b* which is operable to contact an upper end 24*d* of outer tube 24*a* or stop collar 38*c* positioned at the upper end of outer tube 24*a* and secured by a split ring 38*e* and one or more fasteners 38*f*. Downward deflection of center region 12*a* of beam 12, and corresponding downward motion of inner tube 24*b*, is thus substantially precluded as outer flange 38*b* of collar 38*a* contacts stop collar 38*c* at upper end 24*d* of outer tube 24*a*. Although shown as a telescoping tube with a stop collar, clearly other forms of mechanical stops may be implemented to limit deflection of beam 12 without affecting the scope of the present invention. For example, as shown in FIG. 5, a solid or substantially non-adjustable column 25, such as a conventional wooden shore, may be sized to contact the lower floor 20 when the beam 14 is at or near level. The shore or column is secured to the underside of beam 12 and extends downwardly from the beam such that initially, prior to leveling of the beam, a gap G is present between the floor 20 and a lower end of the support. Alternately, the shore or column may be positioned at the lower floor 20 with the initial gap between an upper end of the shore and the beam, without affecting the scope of the present invention. The initial gap G is approximately equal to the initial camber of the beam.

Figure 2:
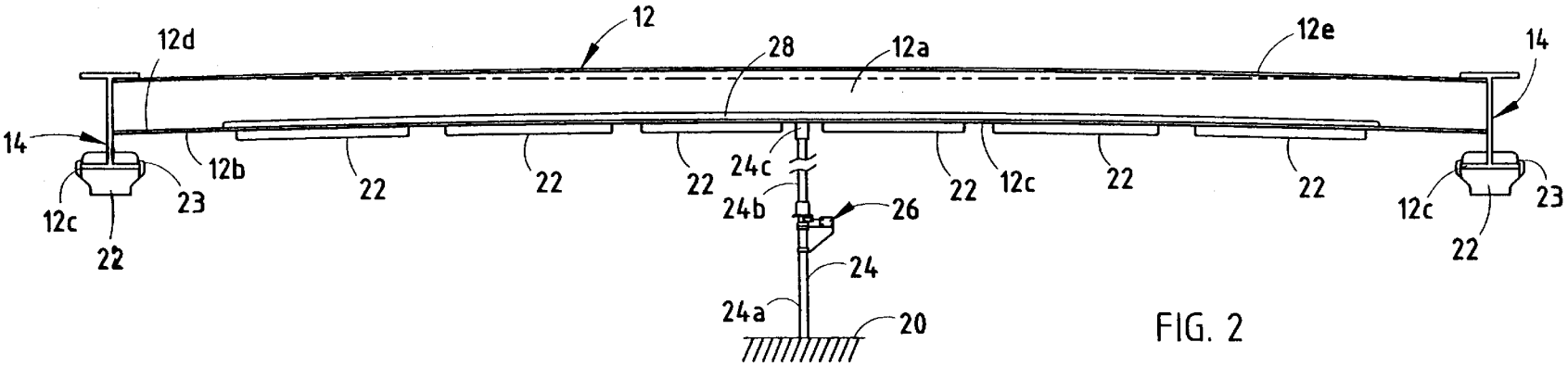
FIG. 2 is a side view of a beam in accordance with the present invention.

As shown in FIGS. 2–4, the beam monitoring device 26 preferably comprises a limit switch which is mounted at upper end 24*d* of lower and outer tube 24*a*, such that a pivot lever or arm 26*a* is engageable with outer flange 38*b* of mechanical stop 38. Lever 26*a* is pivotally mounted to a base 26*b* of monitoring device 26. As the curvature of beam 12 is reduced toward a level orientation, flange 38*b* of mechanical stop 38 correspondingly approaches and engages lever 26*a* of limit switch 26, thereby causing lever arm 26*a* to pivot downwardly from base 26*b* of switch 26. At a predetermined amount of deflection of lever 26*a*, limit switch 26 is operable to deactivate heaters 22 to prevent further leveling of beam 12. Additionally, as beam 12 cools and begins to curve back towards its initial cambered state, lever arm 26*a* of limit switch 26 will pivot upwardly as flange 38*b* moves correspondingly upwardly with the center region 12*a* of beam 12. At a predetermined amount of upward deflection of lever 26*a*, limit switch 26 is operable to reactivate heaters 22 to again reduce the curvature of the beam toward a level orientation. This process is continuously repeated as the concrete is placed and screeded at the beams.

Figure 10:
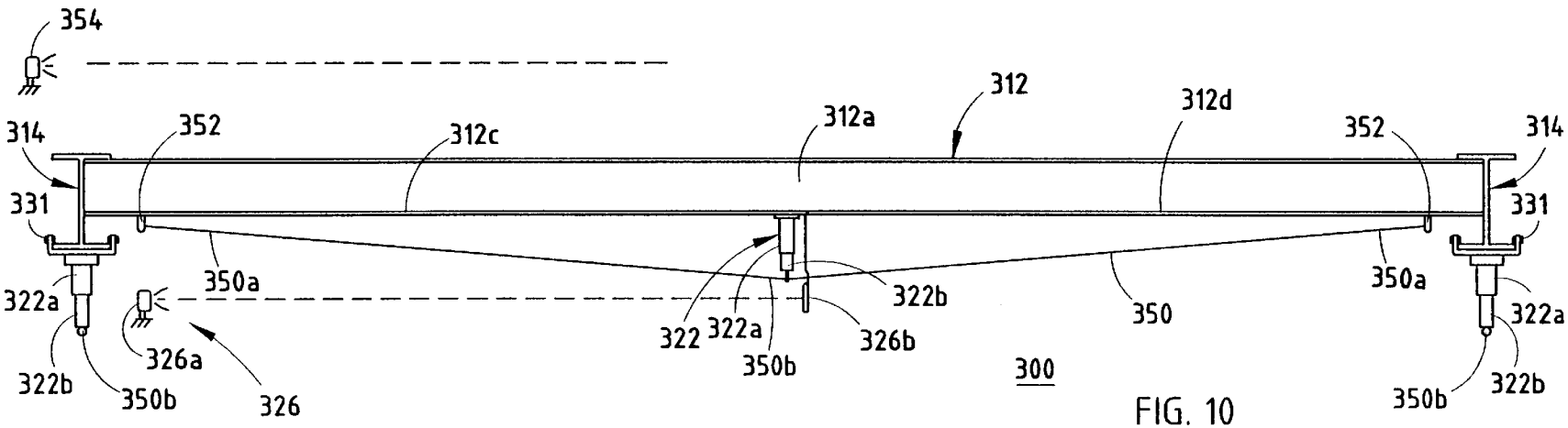
FIG. 10 is a side view of a beam with another alternate embodiment of the present invention positioned generally beneath the beam.

Although shown and described as a limit switch being mounted on a lower tube with a moving collar member contacting a lever arm or switch, clearly the limit switch may be mounted on the upper moving tube and contact a fixed collar member on the lower tube 24*a*, or may be positioned elsewhere at or along beam 12, without affecting the scope of the present invention. Furthermore, although beam monitoring device 26 is shown and described as comprising a limit switch positioned along the adjustable vertical support 24, the monitoring device may be any other means for monitoring the deflection of the beam or girder, without affecting the scope of the present invention. For example, the beam monitoring device 26 may comprise a laser leveling system, as shown in FIG. 10 and discussed below, which comprises a rotating laser beacon which defines a plane of laser light at a fixed position, and one or more laser receivers positioned at the center regions of the beams, an optical sensor, such as a non-contact photo eye, which detects and monitors movement of the center region of each beam, strain gauges positioned along the beams which determine the deflection of the beams, or any other known means for measuring and monitoring a change in curvature of the beams.

Preferably, beam monitoring device 26 and beam adjusting device 22 are continuously operable and may even be variably operable, such that the heat generated by the beam adjusting device 22 may be reduced as center region 12*a* of beam 12 approaches the level position, such as when flange 38*b* initially contacts or approaches arm 26*a* of limit switch 26. The heat generated by the heating device 22 may be further reduced toward zero as the center region 12*a* of beam 12 approaches a level orientation. The amount of heat generated by the heating device 22 may also be variably increased as the beam curves toward its initial cambered state as it cools or as a load, such as heavy equipment of a group of people, is removed from the surface above the beam. Accordingly, shoring system 10 is continuously and variably operable to react to and adjust a curvature of each beam and girder of a targeted bay prior to and during the placing and screeding of the concrete and while the concrete cures.

Although shown and described as comprising a vertical support column, active shoring system 10 may alternately, or in addition thereto, comprise a cooling fan or blower 42, which is operable to rapidly cool the heated portion of the beams to quickly cause the beam to curve back toward its initial cambered state after the heater 22 has been deactivated (FIGS. 6 and 7). Preferably, cooling fan 42 is positioned toward one end of each beam and directs air flow along the heated portion of the beam, such as along the lower surface 12*b* of the lower flange 12*c*, via an air duct 44 or the like extending therealong. The heating device 22 may comprise a blanket heater 22*a*, as discussed above, which is positioned along an upper surface 12*d* of lower flange 12*c*, while the air duct 44 extends beneath the lower flange 12*c*. The cooling fan 42 is operable in response to either the beam monitoring device 26 or deactivation of the heater units 22. Cooling fan 42 functions to enhance cooling of the heated portion of the beams to substantially limit over-deflection of the beams while they are heated and loaded with concrete and/or equipment. As the beam 12 begins to cool in response to deactivation of the heaters 22 and further in response to activation of blower unit 42, the beam 12 will tend to return toward its initial cambered state, thereby curving upwardly to avoid over-deflection and subsequent ponding of the concrete slab. An additional benefit of this approach is that this approach may obviate the need for a vertical support column, such that the entire shoring system 10 is positioned at or near the respective beams and girders, and does not extend downwardly toward the lower level or floor 20, and thus does not interfere with the area below.

Figure 8:
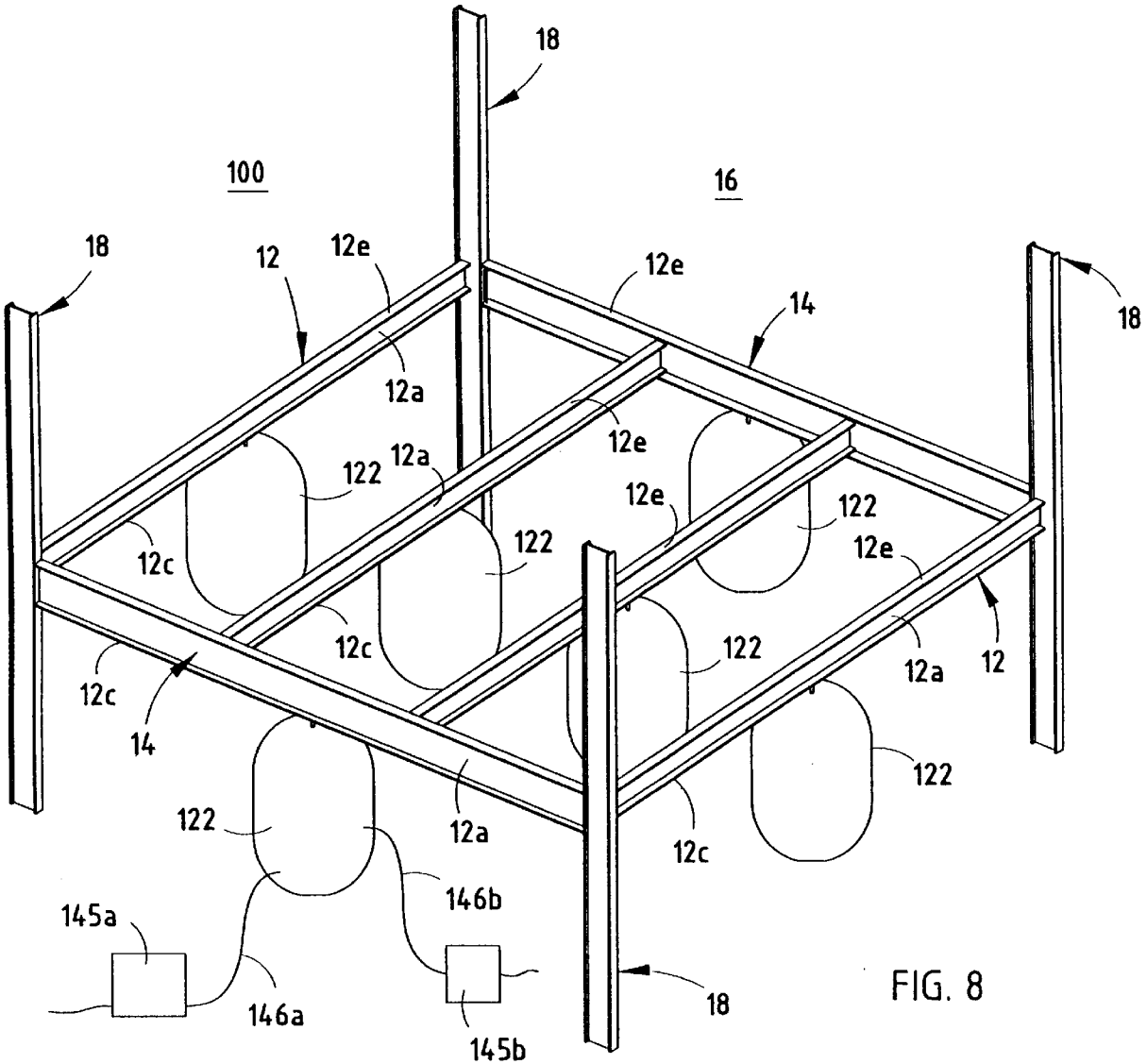
FIG. 8 is a perspective view of another bay, incorporating an alternate embodiment of the present invention.

Referring now to FIG. 8, an active shoring system 100 comprises a plurality of beam adjusting devices or units 122, which are operable to adjust the curvature of each of the-cambered beams 12 and girders 14 of a particular bay 16 of the structure or building. Beam adjusting devices 122 comprise adjustably weighted members, the weight of which may be increased or decreased to adjust the load, and thus the curvature, of the respective beams. The weighted units 122 are removably securable to the center region 12*a* of the beams 12. Preferably, the adjustably weighted units 122 are clipped or otherwise hooked or secured to the lower flange 12*c* of the beams and thus suspend downwardly from the center region 12*a* of each pre-cambered beam or girder. Although not shown, a vertical support column may also be positioned along the center region of the beams to limit over-deflection of the beams, similar to the vertical support 24 discussed above with respect to shoring system 10.

Preferably, the adjusting devices 122 are adjustably weighted so that the weight may be increased to initially load the beam and thus substantially remove the initial camber, and may be decreased to reduce the load on the beams and thus prevent over-deflection of the beams. Preferably, the adjustably weighted units 122 comprise water tanks or containers, whereby water may be pumped into the tanks to increase the weight of the members and pumped out of the tanks to decrease the weight of the members. One or more water pumps 145*a*, 145*b* may be operable to pump water into and out from each of the tanks 122 via water hoses or lines 146*a*, 146*b*, respectively, in response to a signal from a beam monitoring device (not shown in this embodiment). The beam monitoring device may be any means for measuring deflection in beams, similar to beam monitor 26 discussed above with respect to shoring system 10. Water may then be pumped into the tanks until the beam monitor indicates that the beam 12 is straight or level (camber is substantially removed). As the concrete is placed above the beams, the pumps are operable to remove water from the tank to prevent overloading and thus over-deflection of the beams due to the increased load thereupon. Preferably, the water is pumped out from the tanks 122 at one bay 16 and into tanks at an adjacent bay (not shown), thereby eliminating the need for a pumper or water supply truck each time a new bay is to be worked at. The containers 122 preferably comprise a polyethylene material, but may be formed of any other material which is strong and durable enough to support the weight of the water as it is suspended from the beams, without affecting the scope of the present invention.

Figure 9:
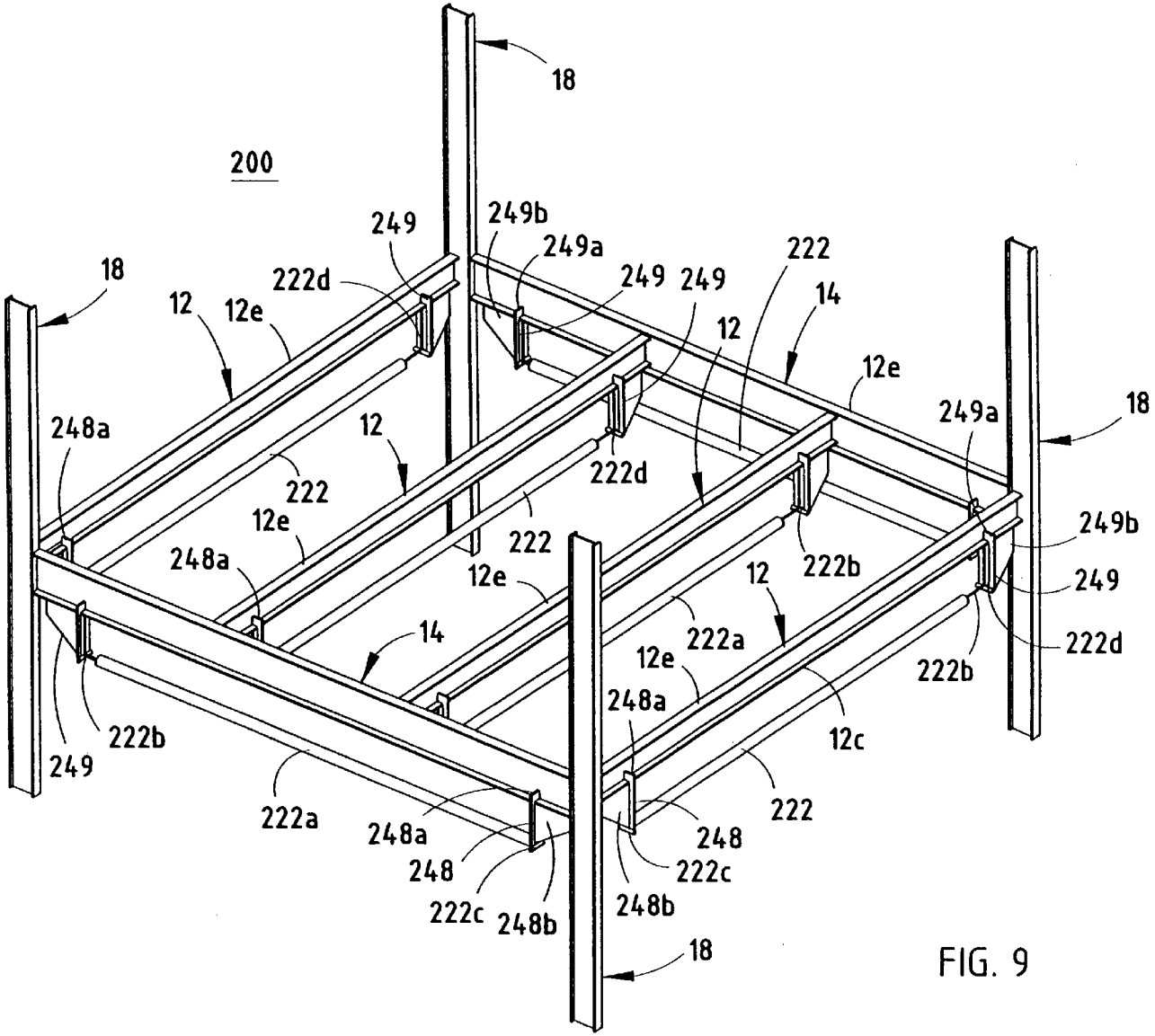
FIG. 9 is a perspective view of yet another bay, incorporating another alternate embodiment of the present invention.

Another alternate embodiment 200 of the present invention is shown in FIG. 9 and comprises a beam adjusting device 222, which is preferably a generally horizontally oriented adjustable member extending along each beam 12 and girder 14 of the targeted bay 16. Preferably, adjustable member 222 comprises a powered, single acting, hydraulic cylinder including a cylinder 222*a* and a rod and piston member 222*b*. An end 222*c* of cylinder 222*a* and an opposite end 222*d* of rod 222*b* are mounted at end brackets 248 and 249, respectively, which are preferably removably mounted at opposite ends of each beam 12. Extension of cylinder 222 produces a bending moment on brackets 248 and 249 and beam 12, which results in pulling downward on beam 12 to reduce the initial upward curvature of the beam. Active shoring system 200 preferably further comprises a beam monitoring or sensing device (not shown) for monitoring the curvature of each beam and girder of bay 16, such that hydraulic cylinder 222 is extendable and releasable to allow retraction or retractable in response to the detected curvature of the beams. The beam monitoring device may be any means of measuring a curvature of the beams, similar to monitoring device 26, discussed above.

Preferably, brackets 248 and 249 comprise a pair of hooks or clips 248*a* and 249*a* which engage lower flange 12*c* of beams 12, such that brackets 248 and 249 and hydraulic cylinder 222 suspend beneath each beam. Each bracket 248 and 249 preferably further comprises a vertical plate 248*b* and 249*b*, respectively, which extends toward the respective ends of the beam and engages the lower surface 12*b* of the flanges 12*c* of each beam. As hydraulic cylinder 222 is extended via pressurizing hydraulic fluid within cylinder 222*a*, as is known in the art, vertical plates 248*b* and 249*b* prevent pivoting of brackets 248 and 249 about hooks 248*a* and 249*a*, respectively, such that the hooks function to pull downward on beam 12, thereby imparting a bending moment on the beam to substantially reduce or remove the camber of the beam. Because brackets 248 and 249 preferably hook over lower flange 12*c* of beams 12, they may be easily removed from beams 12 and installed on a next set of beams and girders after the concrete has cured in bay 16.

Prior to placing the concrete atop the corrugated decking surface, the initial camber in the beams 12 may be at least partially removed by extending hydraulic cylinder 222 until the beam monitoring device senses that the beams are at an approximately level orientation. As concrete is placed at the beams of bay 16, the hydraulic cylinder 222 may be operable by releasing the cylinder pressure to retract or allow retraction to reduce or eliminate the bending moment from the beam, in order to allow the beam to curve back toward its initial cambered state, thereby limiting over-deflection of the beam. Although not shown, active shoring system 200 may further comprise a vertical support column which extends downwardly from a center region of each beam 12 and girder 14, similar to supports 24 discussed above, to substantially preclude over-deflection of the beams as they are loaded. This system 200 also has the ability to deflect the beam center upwards as well as downwards by using double acting hydraulic cylinders in place of single acting fluid cylinder 222, and appropriate beam end brackets which allow the double acting cylinder to either push or pull on the end brackets to deflect the beam center downwardly or upwardly, respectively.

Referring now to FIG. 10, an active shoring system 300 is shown on an initially straight or leveled beam 312, which is not precambered in an initial, upwardly curved state. Active shoring system 300 is implemented at each of a plurality of beams 312 and girders 314 of a particular, targeted bay of a building or structure, and is operable to substantially limit or preclude over-deflection of the beams as concrete is placed and screeded at each bay. The beam adjusting device 322 preferably comprises a powered hydraulic cylinder positionable at a center region 312*a* of beams 312 and a support cable 350 secured at each end 350*a* to a support cable bracket 352 toward each end of beams 312. Preferably, hydraulic cylinder 322 comprises a cylinder 322*a* and a piston/rod assembly 322*b*. Preferably, hydraulic cylinder 322 is mounted at an upper end to lower flange 312*c* of beams 312 via any known means, such as a clamping plate member similar to mounting plates 30 and 32 of active shoring system 10, discussed above, or via locking pins 331 which extend over an upper surface 312*d* of lower flange 312*c* to prevent downward movement of hydraulic cylinder 322 relative to beam 312. A lower end of hydraulic cylinder 322 is engageable with a center region 350*b* of cable 350. Cable 350 is pulled tightly between brackets 352 and is substantially non-elastic such that extension of hydraulic cylinder 322 causes exertion of an upward force on beam 312, since downward movement of cylinder 322 is substantially precluded by cable 350. Because cable 350 is tightly secured and substantially non-elastic, this results in upward movement of cylinder 322 at beam 312 which may bow or curve beam 312 upwards, thereby reducing or substantially precluding downward movement of center region 312*a* of beam 312, and thus any over-deflection in the beam, as the concrete or other loading is placed atop the beams and girders of bay 316.

Because active shoring system 300 is positioned along the underside of the beams and girders, and does not extend down to the floor below, the level or floor below the respective bay area is not interfered with via vertical support columns or the like. However, it is envisioned that the shoring system may comprise a powered hydraulic cylinder which is mounted between the lower floor and the beam and is not supported by a wire, without affecting the scope of the present invention. It is further envisioned that a powered hydraulic cylinder (not shown) may be secured to the lower floor and may be operable to extend and retract in order to adjust the curvature of a pre-cambered beam in either an upwardly or downwardly direction, without affecting the scope of the present invention.

Active shoring system 300 preferably further comprises a beam monitoring device 326, which may comprise any monitoring device, as discussed above with respect to active shoring system 10. As shown in FIG. 10, monitoring device 326 may be a laser leveling system, which comprises at least one laser beacon or transmitter 326*a* and a laser receiver 326*b* attached to and extending downwardly from center region 312*a* of the beams and girders 312. The laser beacon rotates to generate a laser plane and is positioned externally to the beams and girders of the bay. If downward deflection of the beam 312 is detected by the laser receiver, then hydraulic cylinder 322 may be extended to push upwardly on beam 312, thereby preventing over-deflection of the beam as it is loaded. As also shown in FIG. 10, the monitoring device 326 is preferably oriented such that the laser beam emitted from laser transmitter 326*a* is substantially parallel to a laser beam or plane emitted from a concrete placing laser beacon or transmitter 354, which is operable to facilitate level placing and screeding of concrete at the beams 312 and girders 314. Concrete placing laser transmitter 354 is preferably of the type disclosed in commonly assigned U.S. Pat. No. 4,655,633, issued to Somero et al., the disclosure of which is hereby incorporated herein by reference.

Accordingly, the present invention provides an active shoring system which is continuously or intermittently operable to maintain a substantially level orientation of each of the beams and girders of a bay area of a structure or building while concrete is being placed and/or screeded and/or cured atop the bay region. The active shoring system automatically adjusts the curvature of each beam and girder as the load is increased or decreased on the beams and girders. Each beam and girder of the targeted bay area is separately monitored and adjusted during the concrete placing and screeding processes to provide a substantially flat and level orientation of the beams and girders as the concrete is placed thereon. The present invention further precludes the requirement of pre-loading concrete into the designated bay, since the beams and girders may be straightened or leveled to a substantially level initial orientation without loading concrete into the area above them.

Because the bays may be initially leveled without pre-placing concrete, the present invention facilitates placing and screeding concrete floors which are substantially flat, level and of uniform thickness throughout. The present invention thus substantially reduces the likelihood of excess concrete being placed at the bay and thus further reduces the likelihood of ponding of the slabs. The present invention therefore provides an automatic beam leveling or adjusting system which substantially reduces the likelihood of waste of concrete and of repair of uneven floors being necessitated after the concrete has cured. Accordingly, the present invention provides a system and a method or process for allowing the placing and screeding of concrete at elevated slabs which reduces labor and is more efficient, while further producing a flatter, higher quality floor, over conventional methods.

Changes and modifications of these specifically described embodiments can be carried out without departing from the principles of the invention, which is intended to be limited only by the scope of the appending claims, as interpreted according to the principles of patent law.

The embodiments of the invention in which an exclusive property right or privilege is claimed are defined as follows:

1. An active shoring system for adjusting a curvature of at least one beam for supporting concrete, the at least one beam being supported at at least two support points along the at least one beam, said active shoring system comprising:

a beam monitor which is at least partially positionable at the at least one beam and operable to monitor the curvature of a portion of the at least one beam, the portion of the at least one beam being between the support points of the at least one beam; and a beam curvature adjusting device which is operable to selectively adjust the curvature of the portion of the at least one beam in response to said beam monitor, thereby maintaining or adjusting the curvature of the at least one beam while concrete is placed or cured at the at least one beam.

2. The active shoring system of claim 1, wherein said beam curvature adjusting device is adapted to adjust the curvature of at least one cambered beam having an initial form which is upwardly curved.

3. The active shoring system of claim 2, wherein said beam curvature adjusting device is initially actuatable to initially substantially reduce the curvature in the beam prior to placing concrete at the at least one beam.

4. The active shoring system of claim 3, wherein said beam curvature adjusting device is further actuatable to reduce the curvature in response to said beam monitor detecting a first threshold degree of curvature of the at least one beam while concrete is being placed or cured at the at least one beam.

5. The active shoring system of claim 4, wherein said beam curvature adjusting device is further actuatable to allow the at least one beam to curve toward its initial form in response to said beam monitor detecting a second threshold degree of curvature of the at least one beam while concrete is being placed or cured at the at least one beam.

6. The active shoring system of claim 2, wherein said beam curvature adjusting device is intermittently actuatable to reduce the curvature of the at least one beam and to allow the at least one beam to curve toward its initial curved form in response to said beam monitor.

7. The active shoring system of claim 2, wherein said beam curvature adjusting device comprises a heating device positionable along the at least one beam, said heating device being actuatable to heat at least a portion of the at least one beam to reduce the curvature of the at least one beam in response to said beam monitor, and a blower unit for cooling the at least one beam in response to said beam monitor detecting a generally level orientation of the at least one beam, in order to allow the at least one beam to curve toward its initial form.

8. The active shoring system of claim 2, wherein said beam curvature adjusting device comprises at least one weighted member which is suspended from a center region of the at least one beam to at least initially substantially reduce the camber in the at least one beam.

9. The active shoring system of claim 8, wherein said at least one weighted member comprises at least one adjustably weighted member.

10. The active shoring system of claim 9, wherein said at least one adjustably weighted member comprises at least one container which contains a variable amount of material therein.

11. The active shoring system of claim 10, wherein said at least one container contains a variable amount of water and further comprises a pump which is operable to supply water to said at least one container in response to said beam monitor detecting a first threshold curvature in the at least one beam and which is further operable to remove water from said at least one container in response to said beam monitor detecting a second threshold curvature in the at least one beam.

12. The active shoring system of claim 2, wherein said beam curvature adjusting device comprises a generally horizontal adjustable member.

13. The active shoring system of claim 12, wherein said adjustable member is connectable at each end to a mounting bracket at each end of the at least one beam, said adjustable member being extendable to reduce the curvature of the at least one beam and retractable to allow the at least one beam to curve toward its initial form in response to said beam monitor.

14. The active shoring system of claim 13 wherein said adjustable member is a double acting fluid cylinder which is extendable against said mounting bracket at each end to reduce the curvature of the at least one beam, and is retractable to pull said mounting bracket at each end toward one another to increase the curvature of the at least one beam.

15. The active shoring system of claim 12 wherein said generally horizontal adjustable member is a fluid cylinder.

16. The active shoring system of claim 1, wherein said beam curvature adjusting device comprises at least one adjustable vertical support.

17. The active shoring system of claim 16, wherein said at least one adjustable vertical support is positionable at a lower structural surface below the at least one beam, and said at least one adjustable vertical support comprising a mechanical stop which is adapted to substantially limit downward deflection of the at least one beam.

18. The active shoring system of claim 16, wherein said adjustable vertical support is positionable such that an upper end of said beam curvature adjusting device is positioned at a center region of the at least one beam while a lower end of said beam curvature adjusting device is positioned at a cable secured at opposite ends of the at least one beam and extending therebelow.

19. The active shoring system of claim 1, wherein said beam monitor comprises at least one of a limit switch, a laser system, a stringline system, an optical system, and a strain gauge system.

20. The active shoring system of claim 1, wherein said beam curvature adjusting device is continuously operable in response to said beam monitor.

21. The active shoring system of claim 1, wherein said beam curvature adjusting device is intermittently operable in response to said beam monitor detecting at least one threshold degree of curvature of the at least one beam.

22. The active shoring system of claim 1, wherein said beam monitor and said beam curvature adjusting device comprise multiple beam monitors and multiple beam curvature adjusting devices, each of said multiple beam monitors and each of said multiple beam curvature adjusting devices being independently operable at one of multiple beams and girders which combine to form at least one bay.

23. The active shoring system of claim 1, wherein said beam curvature adjusting device is operable to vertically adjust a generally central portion of the at least one beam relative to opposite ends of the at least one beam.

24. An active shoring system for adjusting a curvature of at least one beam for supporting concrete, said active shoring system comprising:

a beam monitor which is operable to monitor the curvature of the at least one beam;

a beam curvature adjusting device which is operable to selectively adjust the curvature of the at least one beam in response to said beam monitor, thereby maintaining or adjusting the curvature of the at least one beam while concrete is placed or cured at the at least one beam, said beam curvature adjusting device being adapted to adjust the curvature of at least one cambered beam having an initial form which is upwardly curved, wherein said beam curvature adjusting device is intermittently actuatable to reduce the curvature of the at least one beam and to allow the at least one beam to curve toward its initial curved form in response to said beam monitor; and a generally vertical support which is operable to substantially limit over deflection of the at least one beam.

25. The active shoring system of claim 24, wherein said generally vertical support is vertically adjustable as the at least one beam flexes upwardly and downwardly.

26. An active shoring system for adjusting a curvature of at least one beam for supporting concrete, the at least one beam having an initial form which is upwardly curved, said active shoring system comprising:

a beam monitor which is operable to monitor the curvature of the at least on e beam; and a beam adjusting device which is operable to selectively adjust the curvature of the at least one beam in response to said beam monitor, thereby maintaining a substantially level beam while concrete is placed at the at least one beam, wherein said beam adjusting device comprises a heating device positionable along the at least one beam, said heating device being actuatable to heat at least a portion of the at least one beam to reduce the curvature of the at least one beam in response to said beam monitor.

27. The active shoring system of claim 26, wherein the at least one beam comprises at least one I-beam having upper and lower flanges, said heating device being positionable along at least one flange of the at least one I-beam.

28. The active shoring system of claim 26, wherein said heating device is variably actuatable to produce more or less heat in response to said beam monitor.

29. An active shoring system for adjusting a curvature of at least one beam for supporting concrete, said active shoring system comprising:

a beam monitor which is operable to monitor the curvature of the at least one beam;

a beam curvature adjusting device which is operable to selectively adjust the curvature of the at least one beam in response to said beam monitor, thereby maintaining or adjusting the curvature of the at least one beam while concrete is placed or cured at the at least one beam, wherein said beam curvature adjusting device is adapted to adjust the curvature of at least one cambered beam having an initial form which is upwardly curved; and a support column.

30. The active shoring system of claim 29, wherein said support column comprises an adjustable support column, said adjustable support column having a mechanical stop to limit over-deflection of the at least one beam.

31. A method for adjusting a curvature of at least one beam prior to and while concrete is placed at the at least one beam, said method comprising the steps of:

providing at least one beam;

monitoring the curvature of said beam with at least one measuring device;

placing concrete such that the concrete is supported at said beam; and adjusting the curvature of said beam in response to said measuring device to maintain a generally level orientation of said beam while placing the concrete.

32. The method of claim 31, wherein said beam comprises at least one pre-cambered beam which comprises an initial form having an upward curvature.

33. The method of claim 32 further comprising the step of initially reducing the curvature of said beam to a generally level orientation of said beam prior to the step of placing concrete at said beam.

34. The method of claim 32, wherein the step of adjusting the curvature of said beam is performed by heating and cooling said beam.

35. The method of claim 34, wherein heating of said beam is performed by at least one heating device positioned along a lower flange of said beam.

36. The method of claim 34, wherein cooling of said beam is enhanced via at least one blower unit positioned along said beam.

37. The method of claim 32 wherein the step of adjusting the curvature of the beam includes cooling an upper flange of the beam to create a temperature differential between the upper and lower beam flanges .

38. The method of claim 32, wherein the step of adjusting the curvature of said beam is performed by suspending a t least one weighted unit from a center region of said beam.

39. The method of claim 38, wherein said weighted unit comprises at least one adjustably weighted unit, the weight of said adjustably weighted unit being increasable to reduce the curvature of said beam and the weight being decreasable to allow said beam to curve upwardly toward its initial curvature.

40. The method of claim 39, wherein said adjustably weighted unit comprises at least one container for containing a variable amount of water and at least one pump for supplying water to said container and for removing water from said container in response to said measuring device.

41. The method of claim 32, wherein the step of adjusting the curvature of said beam is performed by at least one generally horizontal adjustable member positioned along said beam.

42. The method of claim 41, wherein said adjustable member is connectable at each end to a mounting bracket at each end of said beam, said adjustable member being extendable to reduce the curvature of said beam.

43. The method of claim 42 wherein said adjustable member is also retractable to increase the curvature of said beam.

44. The method of claim 31, wherein the step of adjusting the curvature of said beam is performed by at least one adjustable vertical support.

45. The method of claim 44, wherein said adjustable vertical support comprises at least one hydraulic cylinder which is extendable and retractable to adjust the curvature of said beam.

46. The method of claim 45, wherein said adjustable vertical support is positioned at a structural base below said beam and comprises a mechanical stop to limit over deflection of said beam.

47. The method of claim 45, wherein said adjustable vertical support is positionable such that an upper end of said adjustable vertical support is positioned at a center region of said beam while a lower end of said adjustable vertical support is positioned at a cable secured at opposite ends of said beam and extending therebelow.

48. The method of claim 31, further comprising the step of providing a support column which is operable to limit over-deflection of said beam.

49. The method of claim 31, wherein the step of adjusting the curvature of said beam is continuous in response to said at least one measuring device.

50. The method of claim 31, wherein the step of adjusting the curvature of said beam is intermittent in response to said measuring device.

51. The method of claim 31, wherein said measuring device comprises at least one of a limit switch, a laser system, a stringline system, an optical system, and a strain gauge system.

52. The method of claim 31, wherein multiple beams and girders combine to form at least one bay of an elevated slab, the steps of monitoring and adjusting the curvature of said beam being performed independently on each of the multiple beams and girders while placing the concrete.

53. The active shoring system of claim 6 including a generally verticle support which is operable to substantially limit over deflection of the at least one beam, said generally vertical support being vertically adjustable as the at least one beam flexes upwardly and downwardly, wherein said generally vertical suppport comprises a hydraulic cylinder which is extendable and retractable.

54. The active shoring system of claim 2 including a support column comprising a fixed length column which extends between the at least one beam and a floor below the at least one beam, said support column defining a gap between said support column and one of the at least one beam and the floor, the gap being approximately equal to an initial camber in the at least one beam.

* * * * *